United States Patent [19]

Germershausen

[11] 3,951,071

[45] Apr. 20, 1976

[54] DRIVE CAGE SUB-CALIBER PROJECTILE

[75] Inventor: Raimund Germershausen, Kaarst, Germany

[73] Assignee: Rheinmetall G.m.b.H., Dusseldorf, Germany

[22] Filed: July 18, 1974

[21] Appl. No.: 489,484

[30] Foreign Application Priority Data

July 20, 1973 Germany ..... 2336904

[52] U.S. Cl. ..... 102/93

[51] Int. Cl.[2] ..... F42B 13/16

[58] Field of Search ..... 102/93

[56] References Cited

UNITED STATES PATENTS

| | | | |
|---|---|---|---|
| 3,446,147 | 5/1969 | Engal et al. | 102/93 |
| 3,714,900 | 2/1973 | Feldmann | 102/93 |
| 3,724,377 | 4/1973 | Birkigt | 102/93 |

*Primary Examiner*—Charles T. Jordan

*Attorney, Agent, or Firm*—Ernest G. Montague; Karl F. Ross; Herbert Dubno

[57] ABSTRACT

A cap and a bottom part of a drive cage of a projectile are held together by a circularly-shaped metal jacket up to the disintegration of the cap by a centrifugal force or ramming pressure in flight. The jacket is made of longitudinal segments and surrounds the projectile along part of its length.

8 Claims, 2 Drawing Figures

FIG. 1
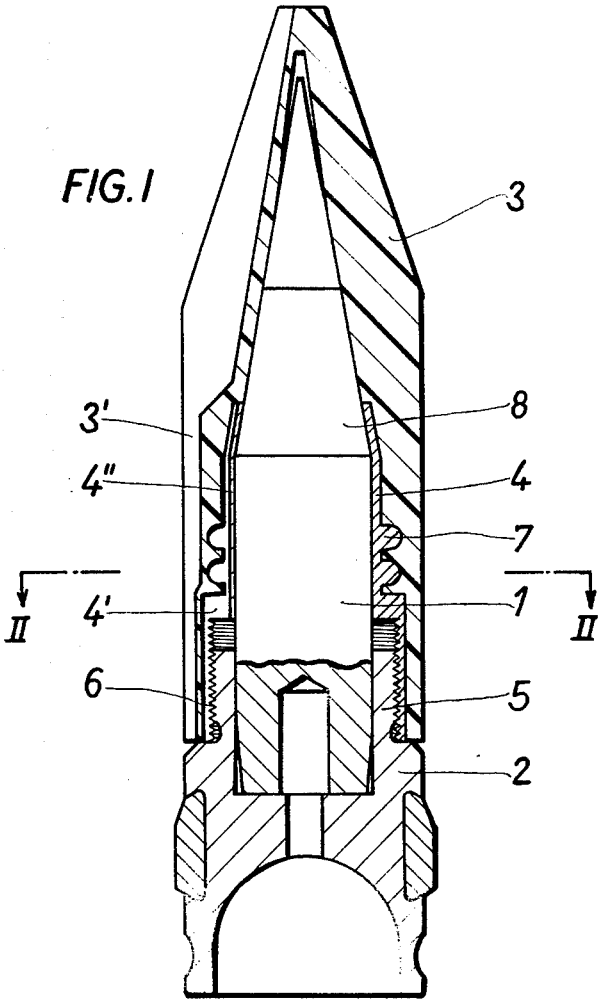
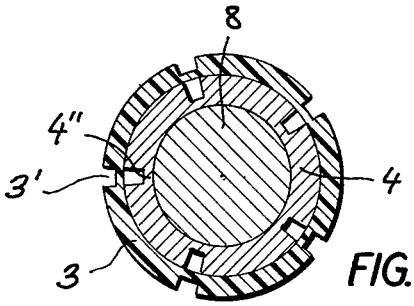
FIG. 2

DRIVE CAGE SUB-CALIBER PROJECTILE

FIELD OF THE INVENTION

My invention relates to a projectile having a drive cage and means to hold the drive cage in place.

BACKGROUND OF THE INVENTION

Projectiles having a drive cage are known, in which a subcaliber projectile is covered by a bottom and a guide-and centering cap made of plastic, the latter being joined to the former by means of a screw thread, the drive cage serving to accelerate the covered projectile.

During the supply of shells using a drive cage to an automatically fired weapon the drive-cage parts are subjected to a stress in an axial direction, the shell reaching velocities of up to 20 meters/second, being suddenly arrested on impact with the shell chamber. The resulting inertial forces of a heavy shell or projectile act in the direction of firing stress particularly on the joint between the metallic bottom and the guide and centering hood. This leads to a rupture of the assembly at the weakest part of its cross-section, i.e. at the joint of the plastic cap with the bottom, particularly during temperature extremes, even in the case of very strong synthetic resin materials.

Axial locking arrangements have already been proposed (see German published application or Offenlegungsschrift No. 2 007 822) to avoid these disadvantages; these arrangements provide for a locking of the projectile to the bottom of the driving cage until it is fired, the resulting lock being broken by the centrifugal force generated during the spin of the projectile in the barrel. Projectiles of this type suffer, however, from uncontrollable errors, due partly to a relatively clumsy mounting procedure, and partly to a lack of reliability of the locking means which can jam during firing.

OBJECTS OF THE INVENTION

It is therefore an object of my invention to avoid the aforesaid disadvantages and in particular to obtain a drive cage attachment of the type described for automatic weapons having a high firing velocity which combines simple construction with a high degree of reliability.

SUMMARY OF THE INVENTION

The above objects are met by the provision of a circularly shaped metal jacket made of longitudinal circular-section segments which surrounds the projectile along part of its length and force-transmittingly joins the drive cap or cage and a bottom part of a drive cage of the projectile up to the disintegration of the cap by a centrifugal force or ramming pressure in flight. The jacket is preferably made of unitary material, formed with longitudinal grooves or slits forming rupture lines and provided with radial projections which are attached to the plastic cap by injection molding, adhesives or by means of a screw thread.

This ensures an unusually firm and secure joint between the projectile and the bottom part of the drive cage capable of withstanding the heavy inertial stresses arising due to the automatic loading procedure. The lack of any moving parts in the locking system simplifies the assembly of the projectile and contributes to the overall reliability of the assembled projectile.

BRIEF DESCRIPTION OF THE DRAWING

The features of my invention will be better understood with reference to the accompanying drawing in which:

FIG. 1 shows a fragmentary cross-section of an assembled projectile in elevation; and FIG. 2 shows a cross-section of FIG. 1 taken along the line II — II.

SPECIFIC DESCRIPTION

FIGS. 1 and 2 show a shell according to my invention. The drive cage projectile consists substantially of a shell formed with a forwardly convergent top cone 8, a bottom part 2, a plastic cap or hood 3 and a metal jacket or sleeve 4. Plastic cap 3 is formed in known fashion with longitudinal grooves or slits 3' on its circumference, which cause its disintegration by a centrifugal force or by ramming pressure following discharge of the projectile from a gun.

Bottom part 2 is formed with a jacket-like extension 5 of reduced diameter for an attachment of the projectile at its longitudinal center and carries a screw thread on its circumference. Plastic cap 3 is attached to bottom part 2 by means of a metal jacket 4 formed on its rear end with an inner thread and connected to the cap by injection molding, glue, or a thread; the jacket itself is formed on its circumference with radial projections 7, which may be part of a thread, and converges conically towards its front end, surrounding a partial region of conical top 8 of the shell.

The circularly-shaped metal jacket 4 is preferably made in unitary fashion of a light alloy and formed with longitudinal grooves or slits 4' forming rupture lines in a fashion similar to those of plastic cap 3. Slits 4' may penetrate the wall of metal jacket 4 completely, as has been illustrated in FIG. 1 within the region of thread 6, so that only longitudinally-shaped segments of the metal jacket remain; but they can also be shaped, as has been illustrated in FIGS. 1 and 2 for the remaining portion of metal jacket 4, so that only a remaining thin connection 4'' of only a few tenths millimeters thickness separates adjoining wall segments of the metal jacket.

I claim:

1. A subcaliber drive cage projectile comprising:

a projectile having a forwardly tapering forward end and a heel at the other end;

a drive cage having a bottom part receiving said heel and an adjoining synthetic-resin releasable cap enclosing said forward end; and a circularly-shaped metal jacket made of longitudinal circular-arc wall segments surrounding said projectile along at least part of the length of said projectile, said cap being attached to said bottom part of said drive cage by means of said jacket.

2. A drive cage projectile as defined in claim 1 wherein said jacket is formed with radial projections, said cap being attached to said jacket by means of said projections.

3. A drive cage projectile as defined in claim 2, wherein said cap is attached to said projections by means of a thread.

4. A drive cage projectile as defined in claim 2 wherein said cap is injection molded onto said projections.

5. A drive cage projectile as defined in claim 2, further comprising an adhesive bonding said cap to said projections by means of glue.

6. A drive cage projectile as defined in claim 1, wherein said jacket surrounds at least part of said tapered forward end.

7. A drive cage projectile as defined in claim 1 wherein said metal jacket is unitary and adjoining wall-segments are separated from each other by means of longitudinal grooves formed in said jacket.

8. A drive cage projectile as defined in claim 7, wherein said longitudinal grooves are slits.

* * * * *